US010540922B2

(12) United States Patent
Kim et al.

(10) Patent No.: US 10,540,922 B2
(45) Date of Patent: Jan. 21, 2020

(54) TRANSPARENT DISPLAY APPARATUS AND DISPLAY METHOD THEREOF

(71) Applicants: SAMSUNG ELECTRONICS CO., LTD., Suwon-si (KR); Korea University Research and Business Foundation, Seoul (KR)

(72) Inventors: Jong-ok Kim, Seoul (KR); Kang-kyu Lee, Seoul (KR); Tae-young Na, Hanam-si (KR); Jae-woo Kim, Seoul (KR); Je-ho Ryu, Seoul (KR)

(73) Assignees: SAMSUNG ELECTRONICS CO., LTD., Suwon-si (KR); Korea University Research and Business Foundation, Seoul (KR)

( * ) Notice: Subject to any disclaimer, the term of this patent is extended or adjusted under 35 U.S.C. 154(b) by 0 days.

(21) Appl. No.: 15/922,345

(22) Filed: Mar. 15, 2018

(65) Prior Publication Data

US 2018/0268754 A1 Sep. 20, 2018

(30) Foreign Application Priority Data

Mar. 15, 2017 (KR) ..... 10-2017-0032425

(51) Int. Cl.
*G09G 3/20* (2006.01)

(52) U.S. Cl.
CPC ... *G09G 3/2011* (2013.01); *G09G 2320/0276* (2013.01); *G09G 2320/0626* (2013.01); *G09G 2320/0666* (2013.01)

(58) Field of Classification Search
CPC ..... G09G 3/2011; G09G 5/02; G09G 2320/0276; G09G 2320/0626;
(Continued)

(56) References Cited

U.S. PATENT DOCUMENTS

2008/0259369 A1* 10/2008 Kanai ..... G06T 11/001 358/1.9
2009/0174725 A1* 7/2009 Kim ..... G09G 5/02 345/590

(Continued)

FOREIGN PATENT DOCUMENTS

JP 2009-219064 A 9/2009
JP 2016-122039 A 7/2016

(Continued)

OTHER PUBLICATIONS

Itoh, et al., "Semi-Parametric Color Reproduction Method for Optical See-Through Head-Mounted Displays", Nov. 2015, IEEE Transactions on Visualization and Computer Graphics, vol. 21, Issue 11, pp. 1269-1278.

(Continued)

*Primary Examiner* — Ke Xiao
*Assistant Examiner* — Jed-Justin Imperial
(74) *Attorney, Agent, or Firm* — Sughrue Mion, PLLC

(57) ABSTRACT

A display method of a transparent display apparatus is provided. The display method includes sensing illumination around the transparent display apparatus; determining threshold lightness using the sensed illumination; correcting image data by changing lightness and chroma of colors which are brighter than the determined threshold lightness by a first method and changing at least one of lightness and chroma of colors which are the determined threshold lightness or less by a second method; and displaying the corrected image data on the transparent display apparatus.

18 Claims, 11 Drawing Sheets

(58) Field of Classification Search
CPC ..... G09G 2320/0666; G06T 11/001; H04N 1/60; H04N 1/6002; H04N 1/6005; H04N 1/6058
See application file for complete search history.

(56) References Cited

U.S. PATENT DOCUMENTS

| | | | | |
|---|---|---|---|---|
| 2012/0154441 | A1* | 6/2012 | Kim | G06K 9/00832 345/633 |
| 2013/0050245 | A1 | 2/2013 | Longhurst et al. | |
| 2014/0063039 | A1 | 3/2014 | Drzaic | |
| 2016/0055619 | A1* | 2/2016 | Lin | G06T 3/0056 345/591 |
| 2016/0270656 | A1* | 9/2016 | Samec | A61B 3/085 |
| 2016/0358582 | A1 | 12/2016 | Lee et al. | |
| 2017/0013695 | A1* | 1/2017 | Kelley | H05B 33/0854 |
| 2017/0061594 | A1* | 3/2017 | Suzuki | G06T 5/009 |

FOREIGN PATENT DOCUMENTS

| | | | |
|---|---|---|---|
| JP | 2016-158014 | A | 9/2016 |
| KR | 10-2006-0081903 | A | 7/2006 |
| KR | 10-1495165 | B1 | 2/2015 |
| KR | 10-2016-0142525 | A | 12/2016 |
| WO | 2016/206990 | A1 | 12/2016 |

OTHER PUBLICATIONS

Sridharan,et al., "Color Correction for Optical See-Through Displays Using Display Color Profiles", 2013, Proceedings of the 19th ACM Symposium on Virtual Reality Software and Technology, 10 pages total.

Morovic, et al., "Gamut mapping algorithms based on psychophysical experiment" 1997, Color and Imaging Conference, vol. 1997, Issue 1, Society for Imaging Science and Technology, pp. 44-49.

* cited by examiner

TRANSPARENT DISPLAY APPARATUS AND DISPLAY METHOD THEREOF

CROSS-REFERENCE TO RELATED APPLICATIONS

This application claims priorities from Korean Patent Application No. 10-2017-0032425, filed on Mar. 15, 2017 in the Korean Intellectual Property Office, the disclosure of which is incorporated herein by reference in its entirety.

BACKGROUND

Field

Apparatuses and methods consistent with the present disclosure relate to a transparent display apparatus and a display method thereof, and more particularly, to a transparent display apparatus and a display method thereof in which loss of chroma experienced by a user is minimized and to which a color gamut mapping taking account of an ambient illumination environment is applied.

Description of the Related Art

In accordance with the development of an electronic technology, apparatuses representing colors have been diversified to meet the needs of users. However, color gamuts of the diverse apparatuses are different from each other and when a color image of an apparatus having a wide color gamut is reproduced by an apparatus having a narrow color gamut, the colors outside the color gamut of the apparatus having the narrow color gamut are not reproduced in an original correct color. Therefore, a color gamut mapping for mapping the colors outside the color gamut to colors inside the color gamut is required.

Research on next generation display apparatuses such as a transparent display apparatus have been recently accelerated.

The transparent display apparatus refers to a display apparatus having transparent property and displaying the background behind the display apparatus as it is, and the user may see necessary information on a screen of the transparent display apparatus while seeing the rear background positioned behind the transparent display apparatus. Therefore, since spatial and time limitations on the conventional display apparatuses may be solved, the transparent display apparatus may be conveniently used in various environments for a variety of applications.

However, since the conventional color gamut mapping technologies are developed to print an image or to display an image on a monitor, there is a problem in that these technologies are not suitable for the transparent display. In particular, since loss of chroma is significant as compared to other displays and color expressiveness of the transparent display is significantly lower than a general monitor display, it was necessary to develop a color gamut mapping technology specialized for such a transparent display apparatus.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a transparent display apparatus and a display method thereof in which loss of chroma experienced by a user is minimized and to which a color gamut mapping taking account of an ambient illumination environment is applied.

According to an aspect of the present disclosure, a display method of a transparent display apparatus includes sensing illumination around the transparent display apparatus; determining threshold lightness using the sensed illumination; correcting image data by changing lightness and chroma of colors which are brighter than the determined threshold lightness by a first method and changing at least one of lightness and chroma of colors which are the determined threshold lightness or less by a second method; and displaying the corrected image data on the transparent display apparatus.

In the correcting of the image data, when a color gamut of the transparent display apparatus is included in a color gamut of the image data, the image data may be corrected by changing the lightness and the chroma of the colors which are brighter than the threshold lightness in the image data and changing only the chroma of the colors which are the threshold lightness or less.

In the correcting of the image data, when a color gamut of the transparent display apparatus is not included in a color gamut of the image data, the image data may be corrected by changing lightness of the image data so that the color gamut of the image data includes the entirety of the color gamut of the transparent display apparatus, changing lightness and chroma of colors which are brighter than the threshold lightness in the image data of which the lightness is changed, and changing only chroma of colors which are the threshold lightness or less.

In the determining of the threshold lightness, the threshold lightness may be determined to be inversely proportional to ambient illumination of the transparent display apparatus.

The display method may further include generating a table for mapping colors in a color gamut of the image data to colors in a color gamut of the transparent display apparatus, wherein in the correcting of the image data, the image data may be corrected using the generated table.

In the generating of the table, when the color gamut of the transparent display apparatus is not included in the color gamut of the image data, the color gamut of the image data may be modified so that lightness of color having maximum chroma among the colors in the color gamut of the image data is equal to lightness of color having maximum chroma among the colors in the color gamut of the transparent display apparatus, and the table defining a correspondence between the colors in the color gamut of the image data and colors in the modified color gamut may be generated.

In the correcting of the image data, the image data may be corrected by primarily changing the colors of the image data to become the colors in the modified color gamut based on the generated table and changing the colors which are not included in the color gamut of the transparent display apparatus among the primarily changed colors to become colors in a predetermined region of the color gamut of the transparent display apparatus.

The display method may further include calculating a ratio of the colors which are not included in the color gamut of the transparent display apparatus among the primarily changed colors, wherein a size of the predetermined region may be adjusted to be proportional to the calculated ratio.

In the correcting of the image data, the image data may be corrected by applying a change rate lower than the colors which are not included in the color gamut of the transparent display apparatus among the primarily changed colors to the colors which are included in the color gamut of the transparent display apparatus to change the primarily changed colors to the colors in the color gamut of the transparent display apparatus.

According to another aspect of the present disclosure, a transparent display apparatus includes a sensor configured to sense illumination around the transparent display apparatus; a processor configured to determine threshold lightness using the sensed illumination, and correct image data by changing lightness and chroma of colors which are brighter than the determined threshold lightness by a first method and changing at least one of lightness and chroma of colors which are the determined threshold lightness or less by a second method; and a transparent display configured to display the corrected image data.

When a color gamut of the transparent display is included in a color gamut of the image data, the processor may correct the image data by changing the lightness and the chroma of the colors which are brighter than the threshold lightness in the image data and changing only the chroma of the colors which are the threshold lightness or less.

When a color gamut of the transparent display is not included in a color gamut of the image data, the processor may correct the image data by changing lightness of the image data so that the color gamut of the image data includes the entirety of the color gamut of the transparent display, changing lightness and chroma of colors which are brighter than the threshold lightness in the image data of which the lightness is changed, and changing only chroma of colors which are the threshold lightness or less.

The processor may determine the threshold lightness to be inversely proportional to ambient illumination of the transparent display apparatus.

The processor may generate a table for mapping colors in a color gamut of the image data to colors in a color gamut of the transparent display and correct the image data using the generated table.

When the color gamut of the transparent display is not included in the color gamut of the image data, the processor may modify the color gamut of the image data so that lightness of color having maximum chroma among the colors in the color gamut of the image data is equal to lightness of color having maximum chroma among the colors in the color gamut of the transparent display, and generate the table defining a correspondence between the colors in the color gamut of the image data and colors in the modified color gamut.

The processor may correct the image data by primarily changing the colors of the image data to become the colors in the modified color gamut based on the generated table and changing the colors which are not included in the color gamut of the transparent display among the primarily changed colors to become colors in a predetermined region of the color gamut of the transparent display.

The processor may calculate a ratio of the colors which are not included in the color gamut of the transparent display among the primarily changed colors, and adjust a size of the predetermined region to be proportional to the calculated ratio.

The processor may correct the image data by applying a change rate lower than the colors which are not included in the color gamut of the transparent display among the primarily changed colors to the colors which are included in the color gamut of the transparent display to change the primarily changed colors to the colors in the color gamut of the transparent display.

The transparent display apparatus may be a head mounted display.

According to still another aspect of the present disclosure, a computer readable recording medium including a program for executing a display method of a transparent display apparatus is provided, wherein the display method includes sensing illumination around the transparent display apparatus; determining threshold lightness using the sensed illumination; correcting image data by changing lightness and chroma of colors which are brighter than the determined threshold lightness by a first method and changing at least one of lightness and chroma of colors which are the determined threshold lightness or less by a second method; and displaying the corrected image data on the transparent display apparatus.

According to still another aspect of the present disclosure, a display method of displaying image data on a transparent display apparatus includes sensing illumination in an environment around the transparent display apparatus; determining a threshold lightness value using the sensed illumination; correcting the image data by changing, using a first method, a lightness and a chroma of colors having a lightness value brighter than the determined threshold lightness value and changing, using a second method, at least one of the lightness and the chroma of colors having a lightness value equal to or less than the determined threshold lightness value; and displaying the corrected image data on the transparent display apparatus.

In the correcting of the image data, in response to a color gamut of the transparent display apparatus being included in a color gamut of the image data, the correcting the image data may further include changing the lightness and the chroma of the colors having lightness values brighter than the threshold lightness value and changing only the chroma of the colors having lightness values equal to or less than the threshold lightness value.

In the correcting of the image data, in response to an entirety of a color gamut of the transparent display apparatus not being included in a color gamut of the image data, the correcting the image data may further include changing a lightness value of the image data so that the color gamut of the image data includes the entirety of the color gamut of the transparent display apparatus, changing the lightness and the chroma of colors having lightness values brighter than the threshold lightness value in the image data of which the lightness value is changed, and changing only the chroma of colors having lightness values equal to or less than the threshold lightness value.

In the determining of the threshold brightness, the determined threshold lightness value may be inversely proportional to an ambient illumination of the transparent display apparatus.

The display method may further include generating a table mapping colors in a color gamut of the image data to colors in a color gamut of the transparent display apparatus. The correcting the image data may further include correcting the image data using the generated table.

The table may be generated such that, in response to an entirety of the color gamut of the transparent display apparatus not being included in the color gamut of the image data, the color gamut of the image data is modified so that a lightness of a color having a maximum chroma among the colors in the color gamut of the image data is equal to a lightness of a color having a maximum chroma among the colors in the color gamut of the transparent display apparatus, and such that the table defines a correspondence between the colors in the color gamut of the image data and colors in the modified color gamut of the image data.

The correcting of the image data may further include first changing the colors of the color gamut of the image data to become the colors in the modified color gamut based on the generated table and changing the colors which are not included in the color gamut of the transparent display apparatus among the first changed colors to become colors in a predetermined region of the color gamut of the transparent display apparatus.

The display method may further include determining a percentage of the first changed colors which are not included in the color gamut of the transparent display apparatus. A size of the predetermined region may be adjusted to be proportional to the determined percentage.

The correcting of the image data may further include changing a color value of colors which are already included in the color gamut of the transparent display apparatus to a smaller degree than a degree of change applied to the colors which are not included in the color gamut of the transparent display apparatus to change the first corrected colors to the colors in the color gamut of the transparent display apparatus.

According to still another aspect of the present disclosure, a transparent display apparatus for displaying image data includes a sensor configured to sense illumination in an environment around the transparent display apparatus; a processor configured to determine a threshold lightness value using the sensed illumination, and correct the image data by changing, using a first method, a lightness and a chroma of colors having a lightness value brighter than the determined threshold lightness value and changing, using a second method, at least one of the lightness and the chroma of colors having a lightness value equal to or less than the determined threshold lightness value; and a transparent display configured to display the corrected image data.

In response to a color gamut of the transparent display being included in a color gamut of the image data, the processor may be further configured to correct the image data by changing the lightness and the chroma of the colors having lightness values brighter than the threshold lightness value and changing only the chroma of the colors having lightness values equal to or less than the threshold lightness value.

In response to an entirety of a color gamut of the transparent display not being included in a color gamut of the image data, the processor may be further configured to correct the image data by changing a lightness value of the image data so that the color gamut of the image data includes the entirety of the color gamut of the transparent display, changing the lightness and the chroma of colors having lightness values brighter than the threshold lightness value in the image data of which the lightness value is changed, and changing only the chroma of colors having lightness values equal to or less than the threshold lightness value.

The determined threshold lightness value may be inversely proportional to an ambient illumination of the transparent display apparatus.

The processor may be further configured to generate a table mapping colors in a color gamut of the image data to colors in a color gamut of the transparent display and correct the image data using the generated table.

In response to the color gamut of the transparent display not being entirely included in the color gamut of the image data, the processor may be further configured to modify the color gamut of the image data so that a lightness of a color having a maximum chroma among the colors in the color gamut of the image data is adjusted to be equal to a lightness of a color having a maximum chroma among the colors in the color gamut of the transparent display. The table may define a correspondence between the colors in the color gamut of the image data and colors in the modified color gamut of the image data.

The processor may be further configured to correct the image data by first changing the colors of the color gamut of the image data to become the colors in the modified color gamut based on the generated table and changing the colors which are not included in the color gamut of the transparent display among the first changed colors to become colors in a predetermined region of the color gamut of the transparent display.

The processor may be further configured to determine a percentage of the first changed colors which are not included in the color gamut of the transparent display, and adjust a size of the predetermined region to be proportional to the determined percentage.

The processor may be further configured to correct the image data by changing colors which are already included in the color gamut of the transparent display to a smaller degree than a degree of change applied to the colors which are not included in the color gamut of the transparent display to change the first corrected colors to the colors in the color gamut of the transparent display.

The transparent display apparatus may be a head mounted display.

According to still another aspect of the present disclosure, a non-transitory computer readable recording medium may include a program for executing a display method of displaying image data on a transparent display apparatus. The display method may include sensing illumination in an environment around the transparent display apparatus; determining a threshold lightness value using the sensed illumination; correcting the image data by changing, using a first method, a lightness and a chroma of colors having a lightness value brighter than the determined threshold lightness value and changing, using a second method, at least one of the lightness and the chroma of colors having a lightness value equal to or less than the determined threshold lightness value; and displaying the corrected image data on the transparent display apparatus.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION

Figure 1:
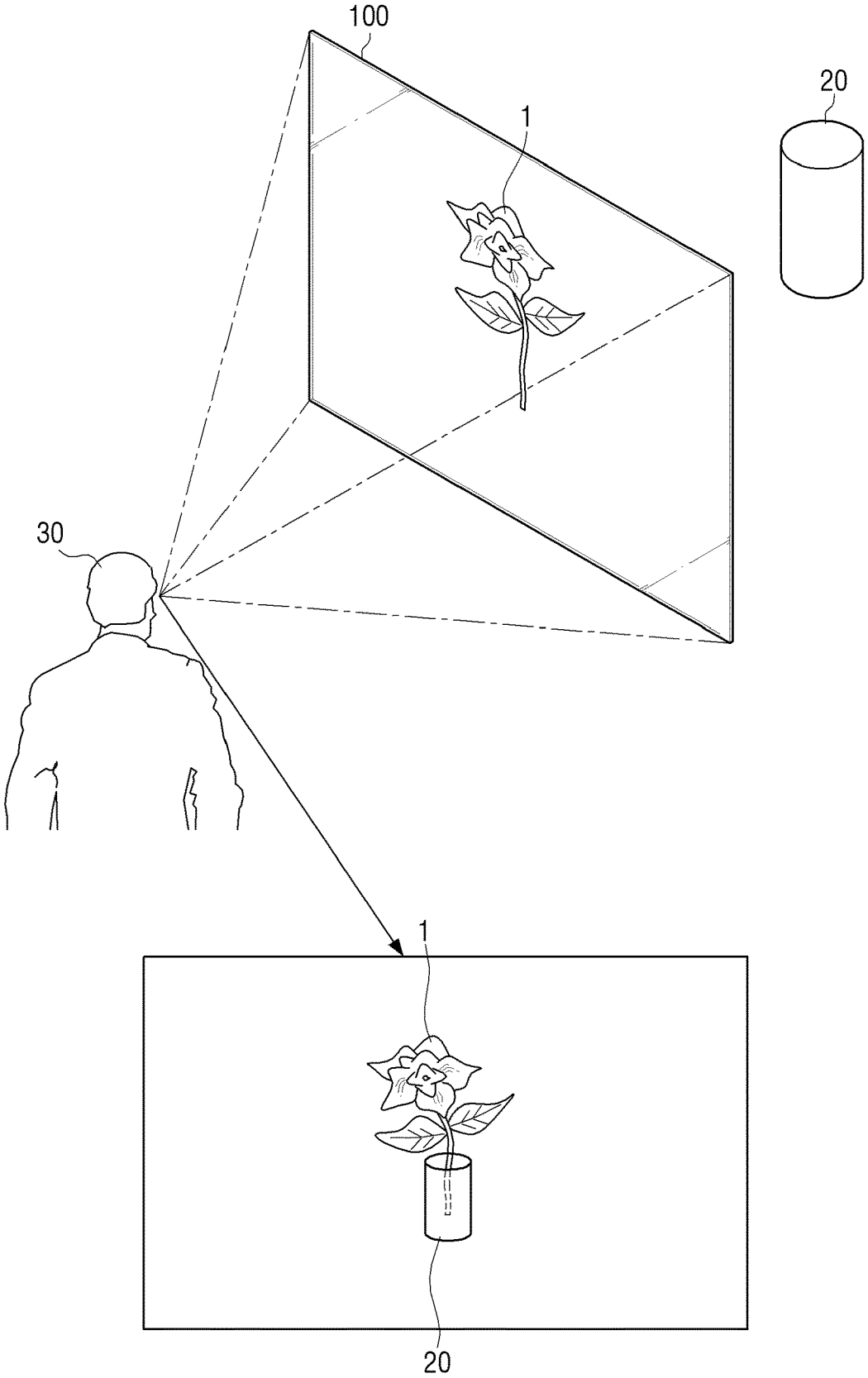
FIGS. 1 and 2 are diagrams illustrating a transparent display apparatus according to diverse exemplary embodiments of the present disclosure.

In describing the present disclosure, a detailed description of related known functions or configurations will be omitted when it is determined that they may make the subject matter of the present disclosure unclear. Further, the following terms are defined in consideration of the functions in the present disclosure and may be varied depending on the user, the intention or relationship of operators, or the like. Therefore, the definition thereof should be based on the contents throughout the present specification.

Terms such as first, second, etc. can be used to describe various components, but the components should not be limited to the terms. The terms are only used to distinguish one component from the others.

The terms used in the present disclosure are only used to describe the specific exemplary embodiments, and are not intended to limit the scope of the present disclosure. As used herein, the singular forms are intended to include plural forms as well, unless the context clearly indicates otherwise. In the present application, the terms "include" or "consist of" intend to designate the presence of features, numbers, steps, operations, components, elements, or a combination thereof that are written in the specification, but do not exclude the presence or possibility of addition of one or more other features, numbers, steps, operations, components, elements, or a combination thereof.

In the exemplary embodiment of the present disclosure, a 'module' or a 'unit' performs at least one function or operation, and may be implemented in hardware, software, or a combination of hardware and software. In addition, a plurality of 'modules' or a plurality of 'units' may be integrated into at least one module and may be implemented in at least one processor, except for a 'module' or a 'unit' in which they need to be implemented in specific hardware.

Hereinafter, embodiments of the present disclosure will be described in detail with reference to the accompanying drawings so that those skilled in the art may easily practice the present disclosure. However, the present disclosure may be implemented in various different ways and is not limited to the embodiments provided in the present description. In the accompanying drawings, portions unrelated to the description will be omitted in order to obviously describe the present disclosure, and similar reference numerals will be used to describe similar portions throughout the present specification.

Hereinafter, the present disclosure will be described in detail with reference to the accompanying drawings.

FIG. 1 is a diagram illustrating a transparent display apparatus according to an exemplary embodiment of the present disclosure.

A transparent display apparatus 100 according to the present disclosure includes a transparent display, and a rear object 20 is transparently viewed. Accordingly, a graphic object 1 displayed on the transparent display apparatus 100 and a real object of the rear object 20 may be synthetically displayed to a user 30.

Figure 2:
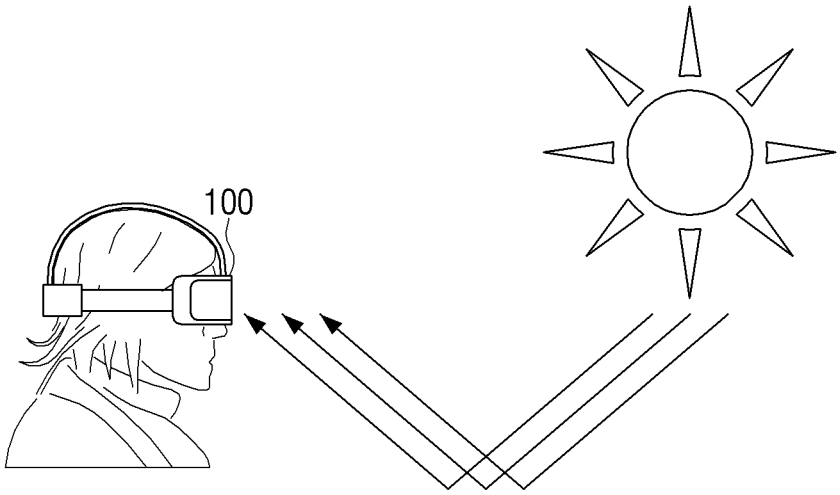

The transparent display apparatus 100 may be implemented in various types of electronic devices such as, for example, a cellular phone, a tablet PC, a TV, a desktop computer, a PMP, and the like, and may be applied to various objects such as furniture, a window, a transparent door, a frame, a show window, a wall, and the like. Besides, the transparent display apparatus 100 may be implemented in a wearable device including a transparent display. For example, as illustrated in FIG. 2, the transparent display apparatus 100 may be implemented in a head mounted display (HMD). Such an apparatus is also referred to as an optical see-through head mounted display (OST-HMD).

The transparent display apparatus 100 implemented in HMD may be suitable for displaying a virtual reality (VR) image in which a viewpoint is moved according to the motion of the user's head. For example, when the user wears the transparent display apparatus 100 implemented in HMD and changes a direction of the head, a portion of the image from the viewpoint corresponding to the direction of the head in the VR image may be displayed through the transparent display. In addition, when the user walks while wearing the transparent display apparatus 100 implemented in HMD, the user may experience the same experience as approaching an object in the image seen through the transparent display. The user wearing transparent display apparatus 100 implemented in HMD may see external real objects together with the VR image through the transparent display.

Meanwhile, due to characteristics of the transparent display of the transparent display apparatus 100, the transparent display apparatus has higher loss of chroma than a general display which is not transparent and is more likely to be exposed to a bright outdoor environment when it is implemented as a wearable device. For example, as illustrated in FIG. 2, since external light passes through the transparent display and reaches the user's eyes, the image may be viewed to be brighter than lightness of an original image displayed on the transparent display.

The transparent display apparatus 100 according to the present display is capable of minimizing the loss of chroma and providing an image adaptive to an ambient lighting by taking account of the above-noted characteristics of the transparent display, and will be described in more detail below.

Figure 3:
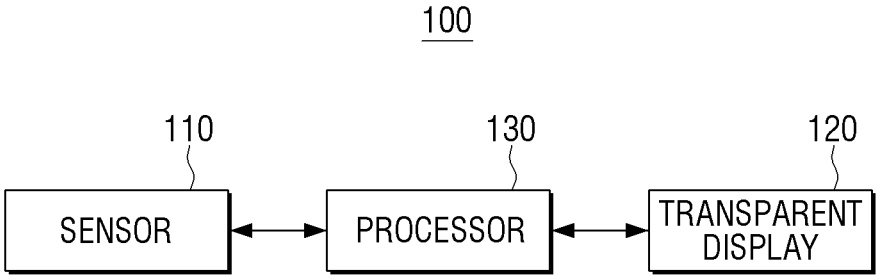
FIG. 3 is a block diagram illustrating a configuration of a transparent display apparatus according to an exemplary embodiment of the present disclosure.

FIG. 3 is a block diagram illustrating a configuration of the transparent display apparatus 100 according to an exemplary embodiment of the present disclosure.

Referring to FIG. 3, the transparent display apparatus 100 includes a sensor 110, a transparent display 120, and a processor 130.

The sensor 110 may sense illumination around the transparent display apparatus 100. The sensor 110 may be for example, an illumination sensor that senses an amount of illumination based on a resistance value which is changed according to an amount of light, or an image sensor included in a camera. An example of the image sensor includes, for example, a charge-coupled device (CCD) sensor or a complementary metal-oxide-semiconductor (CMOS) sensor. However, the sensor 110 is not limited to the example described above, but any sensor may be applied as long as it may sense illumination.

The transparent display 120 may display a graphic object in a state in which an object positioned behind the transparent display 120 is transparently viewed. Here, the graphic object may be a stationary image, a video image, a text, an application execution screen, a web browser screen, or the like.

The transparent display 120 may be implemented in various types such as a transparent liquid crystal display (LCD) type, a transparent thin-film electroluminescent panel (TFEL) type, a transparent organic light emitting diode (OLED) type, a projection type, and the like according to exemplary embodiments.

The transparent LCD type refers to a transparent display apparatus implemented by removing a backlight unit from a general LCD device and using a pair of polarizing plates, an optical film, a transparent thin film transistor, a transparent electrode, and the like. The transparent TFEL type refers to an apparatus using an alternating current inorganic thin film EL display (AC-TFEL) including a transparent electrode, an inorganic fluorescent substance, and an insulating film. The AC-TFEL refers to a display in which electrons accelerated in the inorganic phosphor excite the phosphor while passing therethrough to thereby emit light.

The transparent OLED type refers to a transparent display apparatus using an OLED capable of self emitting light. Since the organic light emitting layer is transparent, when opposite electrodes are used as the transparent electrode, the transparent display may be implemented. The OLED emits light by injecting electrons and holes into opposite sides of the organic light emitting layer to be bonded in the organic light emitting layer. The transparent OLED apparatus displays information by injecting electrons and holes into a desired position using such a principle.

Meanwhile, although not illustrated in FIG. 3, the transparent display apparatus 100 may include a communicator for communicating with various external devices. The communicator may be connected to the external device through a local area network (LAN) and an Internet network and may also be connected to the external device by a wireless communication (e.g., wireless communication such as Z-wave, 4LoWPAN, RFID, LTE D2D, BLE, GPRS, Weightless, Edge Zigbee, ANT+, NFC, IrDA, DECT, WLAN, Bluetooth, Wi-Fi, Wi-Fi Direct, GSM, UMTS, LTE, WiBRO, or the like) scheme. The communicator may include various communication chips such as a Wi-Fi chip, a Bluetooth chip, a wireless communication chip, and the like. The transparent display apparatus 100 may receive image data from the outside through a configuration of the communicator described above.

In addition, although not illustrated in FIG. 3, the transparent display apparatus 100 may include a memory for storing a variety of programs, image data, and the like necessary for an operation of the transparent display apparatus 100. The memory may be implemented, for example, in a non-volatile memory, a volatile memory, a flash-memory, a hard disk drive (HDD), a solid state drive (SSD), or the like. The memory may be accessed by the processor 130, wherein reading/recording/edition/deletion/updating, etc., of data by the processor 130 may be performed. Meanwhile, the memory may be implemented in a storage medium in the transparent display apparatus 100, as well as an external storage medium, for example, a USB or a Web server through a network.

The processor 130 is a configuration for controlling an overall operation of the transparent display apparatus 100. The processor 130 may include a central processing unit (CPU), a random access memory (RAM), a read-only memory (ROM), and a system bus. The processor 130 may include only one CPU, or may be implemented in a plurality of CPUs (or DSPs and SoCs).

The processor 130 may determine a color gamut of the image data. Specifically, the processor 130 may determine the color gamut of the image data based on a format name of the image data, color standard information (e.g., sRGB standard information) of the image data, and the like. For example, in a case in which the image data is a broadcast signal format, since a standard color gamut of the broadcasting signal is an sRGB color gamut, the processor 130 may determine that a color gamut range of the image data is an sRGB color gamut range.

In addition, the processor 130 may also determine the color gamut of the image data based on apparatus information of a device providing the image data. Here, the apparatus information may be apparatus category (e.g., a set-top box, a DVD player, etc.) information of the device and information on the color gamut of the image data output from the corresponding device. For example, in a case in which the apparatus providing the image data is determined as the set-top box, since the set-top box may be an apparatus providing the broadcasting signal format and the standard color gamut of the broadcasting signal is the sRGB color gamut, the processor 130 may determine that the color gamut range of the provided image data is the sRGB color gamut.

The processor 130 may compare a color gamut of the image data with a color gamut of the transparent display 120, and may correct the image data to match the color gamut of the transparent display 120 if it is determined that the color gamut of the image data and the color gamut of the transparent display 120 are different from each other. Such a process is referred to as a color gamut mapping.

As an example, the processor 130 may select an L*a*b* color space for color gamut mapping. In the L*a*b* color space, a value of L* indicates lightness. When L*=0, this indicates black, and when L*=100, this indicates white. a* indicates whether the color is closer to red or green. When a* is a negative number, the color is closer to green, and when a* is a positive number, the color is closer to red. b* indicates yellow and blue. When b* is a negative number, the color is blue, and when b* is a positive number, the color is yellow.

When the color space of the image data is for example, sRGB, the processor 130 may convert the image data into the L*a*b* color space for color gamut mapping. In addition, the processor 130 may perform a color correction, that is, the color gamut mapping based on the converted image data.

As another example, the processor 130 may select an L*C*h* color space for color gamut mapping. In the L*C*h* color space, a value of L* indicates the same lightness as the L*a*b* color space, and a value of C* indicates chroma, such that as the value of C* is increased, saturation of color is increased. The value of C* is a square root value of the sum of squares of the value of a* and the value of b* in the L*a*b* color space. In addition, h* indicates hue, has a unit of degree, and ranges from 0° to 360°, where 0° corresponds to red, 90° corresponds to yellow, 180° corresponds to green, and 270° corresponds to blue.

Besides, various color spaces may be selected for color gamut mapping.

It will be described that the color gamut mapping to be described below is performed in a two-dimensional space of a constant-hue leaf of Lab space. That is, for color gamut mapping, a two-dimensional LC color space of constant-hue is used.

The color gamut mapping according to the present disclosure uses a method of first performing a luminance mapping to concentrate on a chroma compression, varying compression directions of a high luminance region and a low luminance region in consideration of ambient lighting during the chroma compression, and varying a compression rate according to a size of chroma.

Specifically, according to the present disclosure, the color gamut mapping may be performed based on ambient illumination. Specifically, the processor 130 may correct the image data by determining a threshold lightness value, or threshold lightness, using the illumination sensed by the sensor 110, changing lightness and chroma by a first method for color brighter than the determined threshold lightness, and changing at least one of lightness and chroma by a second method which is different from the first method for colors which are the determined threshold lightness or less.

Here, color refers to a color value, and may indicates for example, a value of L* and a value of C*.

The threshold lightness may be determined in a relationship which is inversely proportional to the ambient illumination. That is, as the ambient illumination is increased, the threshold lightness is decreased, and as the ambient illumination is decreased, the threshold lightness is increased.

The processor 130 may determine the threshold lightness based on, for example, a lookup table in which a correspondence between the threshold lightness and the ambient illumination is defined.

When the color gamut (e.g., the two-dimensional LC color space) of the transparent display 120 is included in the color gamut (e.g., the two-dimensional LC color space) of the image data, the processor 130 may correct the image data by changing lightness and chroma of colors which are brighter than the threshold lightness in the image data and changing only chroma of colors which are the threshold lightness or less.

When the color gamut of the transparent display 120 is not included in the color gamut of the image data, the processor 130 may correct the image data by correcting lightness of the image data so that the color gamut of the image data includes the entirety of color gamut of the transparent display, changing lightness and chroma of colors which are brighter than the threshold lightness in the image data of which the lightness is changed, and changing only chroma of colors which are the threshold lightness or less.

Meanwhile, the processor 130 may correct the image data by applying different references to colors included in the color gamut of the transparent display 120 and colors which are not included in the color gamut of the transparent display 120.

Figure 10:
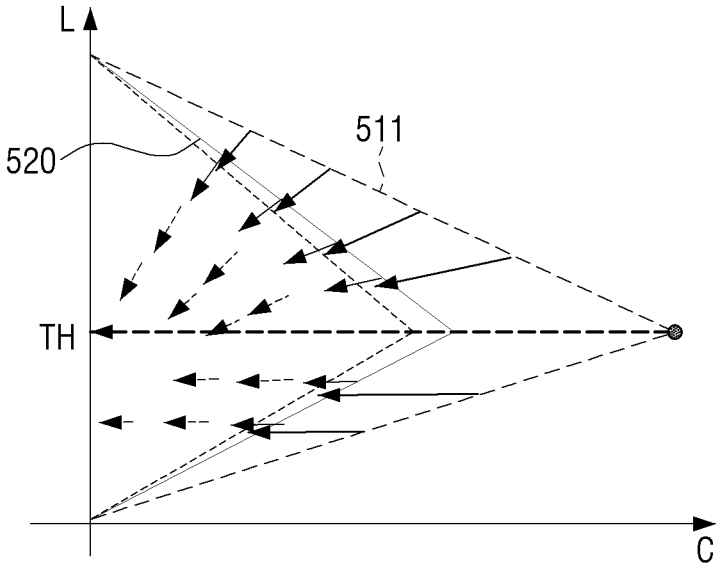

Specifically, as shown in FIG. 10, for example, the processor 130 may correct the image data by applying a change rate to the colors that are already included in the color gamut of the transparent display 120 that is lower than a change rate applied to the colors which are not included in the color gamut of the transparent display 120 in the image data.

In addition, the processor 130 may correct the colors which are not included in the color gamut of the transparent display 120 in the image data to color values corresponding to colors present in a predetermined space in the color gamut of the transparent display 120. In this case, a size of the predetermined space may be adjusted to be proportional to a percentage, or ratio, of the colors in the image data which are not included in the color gamut of the transparent display 120.

The processor 130 may generate a table for mapping colors in the color gamut of the image data to colors in the color gamut of the transparent display 120, and may correct the image data using the generated table.

Specifically, when the color gamut of the transparent display 120 is not included in the color gamut of the image data, the processor 130 modifies the color gamut of the image data so that lightness of color (cusp color) having maximum chroma among the colors in the color gamut of the image data is equal to lightness of color (cusp color) having maximum chroma among the colors in the color gamut of the transparent display 120, and may generate a table defining a correspondence between the colors in the color gamut of the image data and colors in the modified color gamut.

In addition, the processor 130 performs a first, or primary, correction so that the colors of the image data become the colors in the modified color gamut, based on the generated table. If the modified color gamut is obtained by moving only the lightness of the color gamut of the image data, the primary correction is a correction by only the lightness. In this case, the primary correction may be referred to as a lightness correction or a lightness mapping.

In addition, the processor 130 may change lightness and chroma of colors which are brighter than the threshold lightness among the primarily corrected colors to correct the colors to the colors in the color gamut of the transparent display 120, and may change only chroma of colors which are the threshold lightness or less among the primarily corrected colors to correct the colors to the colors in the color gamut of the transparent display 120.

In this case, the processor 130 may correct colors which are not included in the color gamut of the transparent display 120 among the primarily corrected colors to colors in a predetermined region of the color gamut of the transparent display 120.

A size of the predetermined region may be changed depending on an attribute of the image data. Specifically, the processor 130 may calculate a ratio of the colors which are not included in the color gamut of the transparent display among the primarily corrected colors, and may adjust the size of the predetermined region to be proportional to the calculated ratio.

Meanwhile, the processor 130 may correct the primarily corrected colors to the colors in the color gamut of the transparent display by applying a change rate to the colors which are already included in the color gamut of the transparent display 120 that is lower than a change rate applied to the colors which are not included in the color gamut of the transparent display 120 among the primarily corrected colors.

Figure 4:
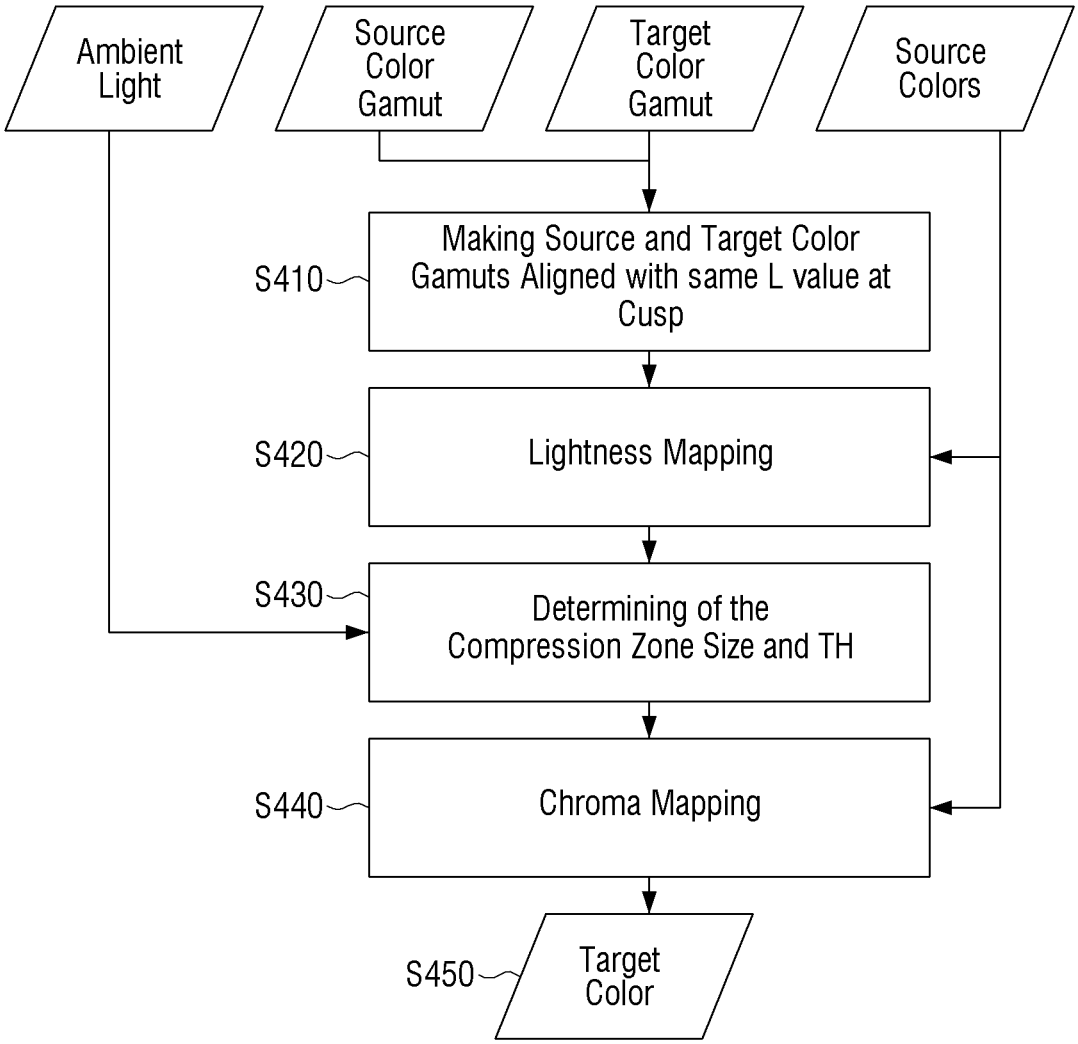
FIG. 4 is a flowchart illustrating a color gamut mapping method according to an exemplary embodiment of the present disclosure.

FIG. 4 is a flowchart illustrating a color correcting method (or color gamut mapping method) of image data according to an exemplary embodiment of the present disclosure.

Referring to FIG. 4, first, information on a color gamut (or a source color gamut) of image data and a color gamut (or a target color gamut) of the transparent display 120 are acquired. The information on the color gamut of the image data may be acquired, for example, through a format of the image data, and the information on the color gamut of the transparent display 120 may be stored in a memory of the transparent display apparatus 100.

Figure 5:
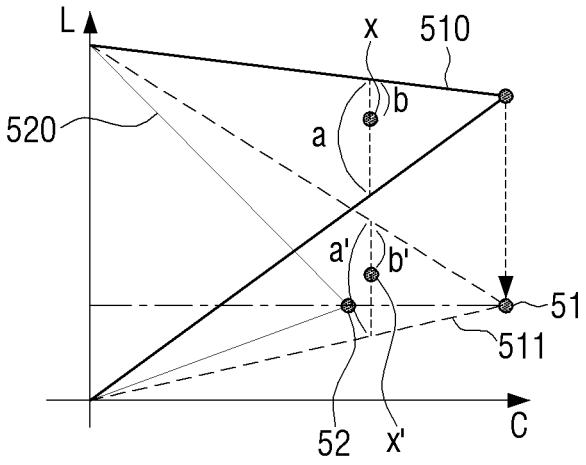
FIGS. 5 to 10 are diagrams illustrating the respective steps of FIG. 4.

For convenience of explanation, FIG. 5 illustrates a color gamut (L*C* color space) of the image data and a color gamut (L*C* color space) of the transparent display 120. Specifically, one of two color gamuts illustrated in FIG. 5 is a color gamut 510 of the image data and the other is a color gamut 520 of the transparent display 120.

Referring back to FIG. 4, the processor 130 aligns the color gamut of the image data and the color gamut of the transparent display 120 to have the same value of L* at the cusp color so that the color gamut of the image data includes the entirety of the color gamut of the transparent display 120 (S410). The cusp color refers to a color having maximum chroma. The step (S410) will be again described with reference to FIG. 5. The processor 130 acquires a third color gamut 511 having a cusp color 51 which is matched to a value of L* of a cusp color 52 of the color gamut 520 of the transparent display 120 by modifying the color gamut 510 of the image data to include the color gamut 520 of the transparent display 120. The method for matching values of L* of the cusp color of both color gamuts is merely one example, and any method may be used as long as it modifies the color gamut 510 of the image data to include the color gamut 520 of the transparent display 120.

In this case, the processor 130 may generate a table in which a correspondence between colors in the color gamut 510 of the image data and colors in the third color gamut 511 is defined. Specifically, referring to FIG. 5, for example, the processor 130 may generate a table defining a relation that a color x in the color gamut 510 of the image data corresponds to a color x' in the third color gamut 511 based on a proportional relation, that is, a:b=a':b'. Other colors in the color gamut 510 of the image data may also correspond to colors in the third color gamut 511 in the same way. In this method, chroma of each of the colors is maintained to be the same as each other and only lightness is changed.

Based on the table defining the correspondence described above, the processor 130 performs a correction (or a lightness mapping) of the colors of the image data to the colors in the third color gamut 511 (S420).

Meanwhile, if the color gamut of the image data already includes the color gamut of the transparent display 120, the step S410 may be omitted. Alternatively, even if the color gamut of the image data already includes the color gamut of the transparent display 120, the step (S410) may be performed to match the values of L* of the cusp color of both color gamuts.

In addition, the processor 130 may determine threshold lightness TH and determine a compression zone (S430). The determination of the threshold lightness and the compression zone will be described in more detail below.

In addition, the processor 130 performs a chroma correction (chroma mapping) for the colors corrected (mapped) in the step S420. Specifically, the processor 130 may modify the colors of which the lightness is corrected in the step S420 to the colors in the color gamut of the transparent display 120 by applying different references to colors which are brighter than the threshold lightness TH among the colors of which the lightness is corrected in the step S420 and colors which are darker than the threshold lightness TH. This will be described with reference to FIG. 6.

Figure 6:
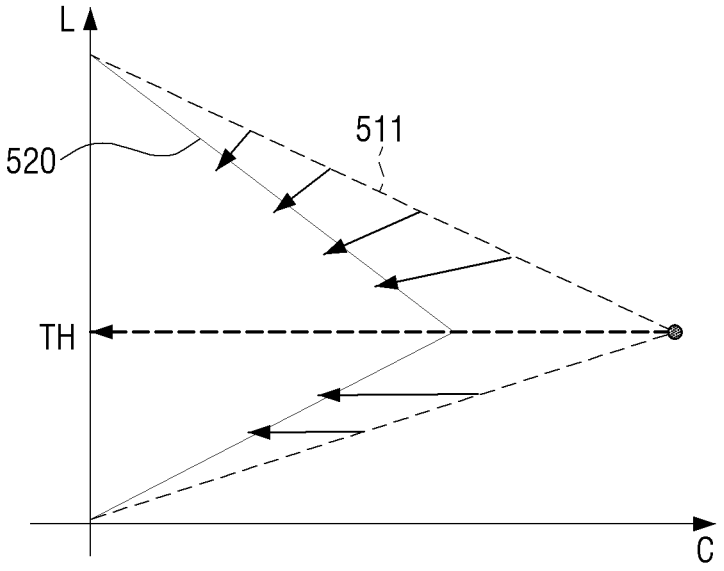

Referring to FIG. 6, the color gamut 520 of the transparent display 120 and the third color gamut 511 which are described in FIG. 5 are illustrated, and FIG. 6 illustrates that the colors mapped into the third color gamut 511 in the step S420 are mapped to the colors in the color gamut 520 of the transparent display 120, using arrows. Here, it may be seen that a gradient of an arrow indicating the mapping of the colors which are brighter than the threshold lightness TH and a gradient of an arrow indicating the mapping of the colors which are darker than the threshold lightness TH are different from each other. That is, the colors which are brighter than the threshold lightness TH and the colors which are darker than the threshold lightness TH are mapped to the colors in the color gamut 520 of the transparent display 120 according to different references.

According to an exemplary embodiment, the processor 130 may map the colors which are brighter than the threshold lightness TH among the colors mapped to the colors in the third color gamut 511 to the colors in the color gamut 520 of the transparent display 120 by changing both chroma and lightness of the colors which are brighter than the threshold lightness TH, and may map the colors which are darker than the threshold lightness TH among the colors mapped to the third color gamut 511 to the colors in the color gamut 520 of the transparent display 120 by changing only chroma of the colors which are darker than the threshold lightness TH. This will be again described with reference to the arrow of FIG. 6. Since the colors which are darker than the threshold lightness TH among the colors mapped to the colors in the third color gamut 511 are mapped to the colors in the color gamut 520 of the transparent display 120 by decreasing only the chroma without decreasing the lightness, there is no gradient of the arrow indicating a mapping direction. On the other hand, since the colors which are brighter than the threshold lightness TH among the colors in the third color gamut 511 were mapped to the colors in the color gamut 520 of the transparent display 120 by decreasing the lightness as well so that the chroma may be less decreased, the arrow indicating the direction of the mapping is inclined.

According to an exemplary embodiment, the colors which are brighter than the threshold lightness TH among the colors mapped to the third color gamut 511 may be mapped so that a straight line connecting the cusp color of the color gamut 520 of the transparent display 120 with the cusp color of the third color gamut 511 is directed to a point (anchor) which is in contact with an L axis.

Meanwhile, the reason that the different mapping methods are used depending on the lightness of the color in the step S440 as described above is because it is necessary to minimize loss of chroma since the loss of chroma is more significant than in a general, non-transparent display. In the case of a transparent display, a degradation in lightness may be improved by an external lighting even if the lightness of the image is degraded since light of an ambient light source (e.g., a lighting or sunlight) is directed to the eyes of the user while passing through the transparent display 120. Therefore, the color gamut mapping is performed for colors which are brighter than specific lightness so that the loss of chroma is minimized even if the lightness is lost. However, in the case of the colors which are darker than the specific lightness, since a degree of compensation of lightness by the external light source is insignificant, the color gamut mapping is performed to have only loss of chroma without loss of lightness. In other words, loss of chroma may be minimized above the threshold lightness, by reducing lightness in addition to chroma, because the external lighting source at least partially compensates for the reduction in lightness. The external lighting source cannot compensate for any reduction in lightness for darker colors, so only chroma is reduced for the darker colors.

Meanwhile, the method for determining the threshold lightness in the step S430 will be described in more detail. The threshold lightness TH may be determined according to ambient illumination of the transparent display apparatus 100. Specifically, the processor 130 may determine the threshold lightness TH to be inversely proportional to an amount of illumination sensed by the sensor 110. That is, if an ambience is bright, the threshold lightness TH is decreased, and if the ambience is dark, the threshold lightness TH is increased.

Figure 7:
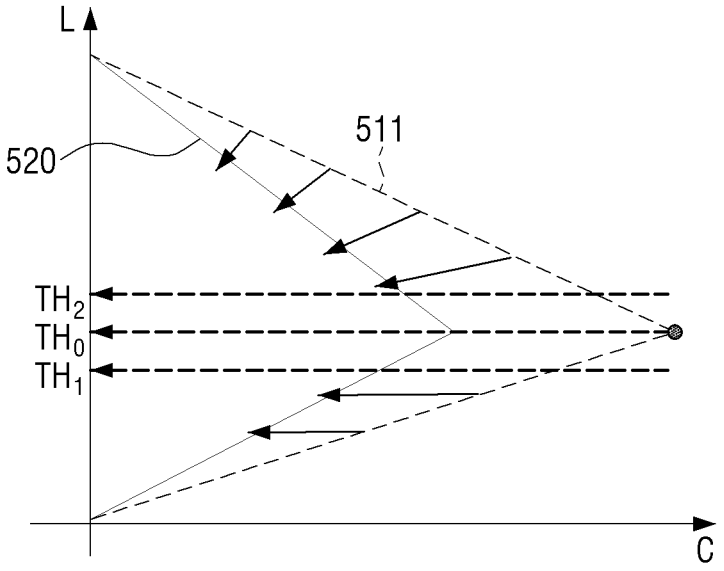

As a specific example, referring to FIG. 7, the processor 130 may set a point at which a straight line connecting the cusp color of the color gamut 520 of the transparent display with the cusp color of the third color gamut 511 is in contact with the L axis as a reference lightness $TH_0$, and may determine threshold lightness $TH_1$ by subtracting a value corresponding to an exceeded amount of illumination from the reference lightness when the amount of illumination sensed by the sensor 110 exceeds a predetermined amount of illumination. On the other hand, if the amount of illumination sensed by the sensor 110 is smaller than the predetermined amount of illumination, the processor 130 may determine threshold lightness $TH_2$ by adding a value corresponding to the small amount of illumination to the reference lightness.

As such, the reason that the threshold lightness is adjusted to be inversely proportional to the ambient illumination is to increase a ratio of colors for which lightness is reduced when an amount of ambient illumination is high, and to decrease a ratio of colors for which lightness is reduced when the amount of ambient illumination is low.

Figure 8:
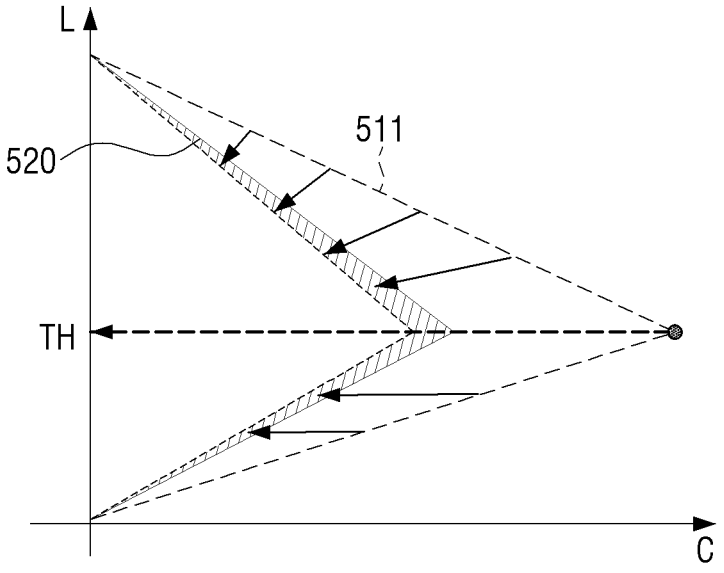

Meanwhile, the mapping zone mentioned in the step S430 will be described as follows. The processor 130 may set a specific region in the color gamut 520 of the transparent display 120, and may map colors out of the color gamut 520 of the transparent display 120 among the colors mapped to the third color gamut 511 in the step S420 to the set region in the step S440. Such a region may be referred to as a mapping zone. Referring to FIG. 8, a hatched region in the second color gamut 520 corresponds to the mapping zone described above.

Figure 9:
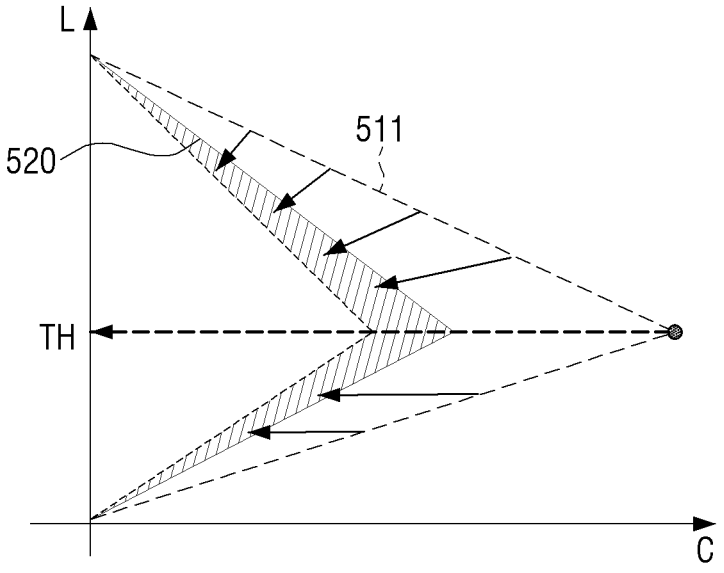

The processor 130 may calculate a ratio of colors which are not included in the second color gamut 520 among the colors corrected (mapped) to the colors in the third color gamut 511 in the step S420, and may adjust a size of the mapping zone described above to be proportional to the calculated ratio. That is, as a result of mapping the colors (source colors) in the image data to the colors in the third color gamut 511, as the colors which are not included in the second color gamut 520 are increased in the mapped colors, the mapping zone is increased. FIG. 9 illustrates an increased mapping zone as compared to FIG. 8.

The reason that the size of the mapping zone is adjusted in consideration of the colors of the image data to be displayed is as follows. In some image data, there may be many colors which are out of the color gamut of the transparent display 120, and in this case, when the mapping zone is set to be small, there is a problem in that the colors which are out of the color gamut of the transparent display 120 are concentrated on the small mapping zone and are saturated.

Meanwhile, according to the present disclosure, the color gamut mapping may be performed for the colors which are not out of the color gamut of the transparent display 120, as well as the colors which are out of the color gamut of the transparent display 120. This will be described with reference to FIG. 10.

Referring to FIG. 10, when the mapping of the step S440 is performed, the mapping is also performed for the colors which are included in the second color gamut 520 among the colors mapped to the third color gamut 511 as illustrated by arrows represented in dotted lines.

In this case, the colors which are included in the second color gamut 520 among the colors mapped to the third color gamut 511 may be mapped at a change rate lower than the colors which are not included in the second color gamut 520 among the colors mapped to the third color gamut 511. In other words, a difference between color values before and after the mapping for colors which are included in the second color gamut 520 is smaller than a difference between color values before and after the mapping for colors which are not included in the second color gamut 520. The arrows illustrated in FIG. 10 have a length corresponding to the change rate. It may be seen that the length of the arrow becomes shorter as it goes inwardly.

The reason that the color gamut mapping is also applied to the colors which may be represented in the color gamut of the transparent display 120 as described above is because more natural color may be represented when the color gamut mapping is applied to the entirety of the colors.

If the mapping in the step S440 as described above is performed, finally corrected color (target color) may be acquired (S450).

According to the present disclosure described above, since the lightness mapping (corresponding to the step S420) and the chroma mapping (S440) are performed in two separated steps, it is possible to increase a preservation rate of chroma. Further, during the chroma mapping (S440), it is possible to reduce loss of chroma by allowing a decrease in lightness for bright colors.

Further, according to the present disclosure described above, since the color gamut mapping may be adaptively performed according to the ambient illumination, it is possible to solve a disadvantage in that the transparent display 120 is significantly affected by the ambient illumination as compared to other general displays. Further, since the size of the compression zone of the color gamut mapping may be determined in consideration of color attributes of the image data, it is possible to solve the problem in that the colors which are out of the color gamut of the transparent display 110 among the colors of the image data are concentrated on the specific color.

Figure 11:
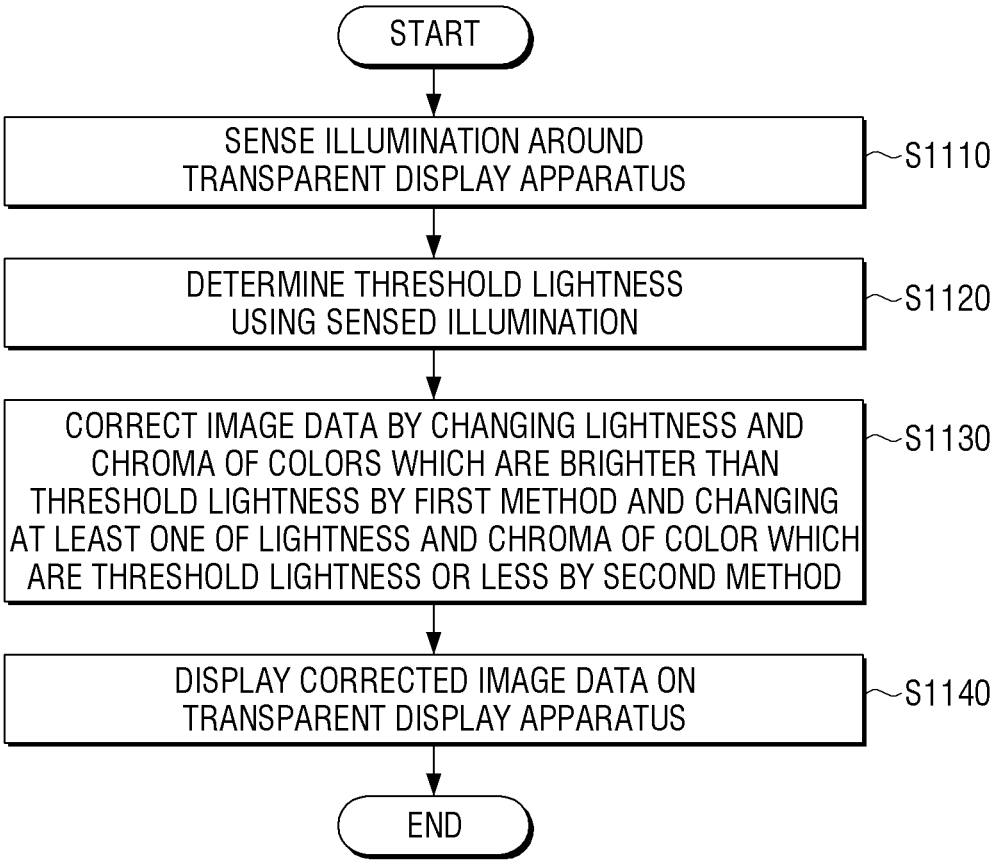
FIG. 11 is a flowchart illustrating a display method of a transparent display apparatus according to an exemplary embodiment of the present disclosure.

FIG. 11 is a flowchart illustrating a display method of a transparent display apparatus according to an exemplary embodiment of the present disclosure. The flowchart illustrated in FIG. 11 may include the operations processed by the transparent display apparatus 100 illustrated in FIG. 3. Accordingly, although being omitted hereinafter, the contents described with connection with the transparent display apparatus 100 with reference to FIGS. 3 to 10 may also be applied to the flowchart illustrated in FIG. 11.

Referring to FIG. 11, the transparent display apparatus 100 senses illumination around the transparent display apparatus 100 (S1110).

The transparent display apparatus 100 may for example, sense the ambient illumination using an illumination sensor embedded in the transparent display apparatus 100. As another example, the transparent display apparatus 100 may include a camera, and may sense the ambient illumination by analyzing an image photographed by the camera.

In addition, the transparent display apparatus 100 determines threshold lightness using the sensed illumination (S1120). The transparent display apparatus 100 may for example, determine the threshold lightness by applying a value of the sensed illumination to a predefined function. As the ambient illumination is lower, the threshold lightness has a large value. That is, a relationship between the ambient illumination and the threshold lightness is inversely proportional.

In addition, the transparent display apparatus 100 corrects the image data by changing lightness and chroma of colors which are brighter than the threshold lightness by a first method and changing at least one of lightness and chroma of colors which are the threshold lightness or less by a second method (S1130).

The image data may be previously stored in the transparent display apparatus 100 and may be provided from an external image providing apparatus. For example, the image data may be a broadcasting signal transmitted from a broadcasting station or a satellite in a wired or wireless scheme, may be image contents transmitted through a HDMI cable, an AV terminal, or the like from a DVD player, a Blu-ray player, or the like, and may also be image contents transmitted through a USB terminal or the like from a cellular phone, a computer, or the like.

In the step S1130, if the color gamut of the transparent display apparatus 100 is included in the color gamut of the image data, the image data may be corrected by changing lightness and chroma of colors which are brighter than the threshold lightness in the image data and changing only chroma of colors which are the threshold lightness or less.

Accordingly, since a cognitive lightness difference is not greatly felt for colors which are the threshold lightness or more, it is possible to concentrate on preventing loss of chroma. In addition, since the lightness difference is greatly felt for the colors which are the threshold lightness or less, it is possible to concentrate on preventing loss of lightness.

Alternatively, in the step S1130, when the color gamut of the transparent display apparatus 100 is not included in the color gamut of the image data, the processor 130 may correct the image data by changing lightness of the image data so that the color gamut of the image data includes the entirety of color gamut of the transparent display apparatus 100, changing lightness and chroma of colors which are brighter than the threshold lightness in the image data of which the lightness is changed, and changing only chroma of colors which are the threshold lightness or less.

As described above, it is possible to minimize the loss of chroma by separately performing the lightness change and the chroma change.

Meanwhile, the display method may further include generating a table for mapping colors in the color gamut of the image data to colors in the color gamut of the transparent display apparatus 100.

Specifically, when the color gamut of the transparent display apparatus 100 is not included in the color gamut of the image data, the display apparatus 100 modifies the color gamut of the image data so that lightness of color having maximum chroma among the colors in the color gamut of the image data is adjusted to be equal to lightness of color having maximum chroma among the colors in the color gamut of the transparent display 100, and may generate a table defining a correspondence between the colors in the color gamut of the image data and colors in the modified color gamut.

In addition, the step S1130 may be performed based on the generated table.

Specifically, the transparent display apparatus 100 may primarily change the colors of the image data to become the colors in the modified color gamut based on the generated table, and may change the colors which are not included in the color gamut of the transparent display apparatus among the primarily changed colors to become colors in a predetermined region of the color gamut of the transparent display apparatus. Here, a size of the predetermined region may be adjusted by a ratio of the colors which are not included in the color gamut of the transparent display apparatus among the primarily changed colors.

In addition, the transparent display apparatus 100 may change the primarily changed colors to the colors in the color gamut of the transparent display apparatus 100 by applying a change rate to the colors which are already included in the color gamut of the transparent display apparatus 100 that is lower than a change rate applied to the colors which are not included in the color gamut of the transparent display apparatus 100 among the primarily changed colors.

According to the diverse exemplary embodiments described above, there are advantages that the loss of chroma felt by the user is minimized in consideration of characteristics of the transparent display apparatus, and the color gamut mapping taking account of the ambient lighting may be performed.

Meanwhile, the display method of the transparent display apparatus according to the diverse exemplary embodiments described above may be stored in a non-transitory readable medium. Such a non-transitory readable medium may be mounted and used in various apparatuses.

A non-transitory readable medium does not mean a medium that stores data for a short period such as a register, a cache, a memory, or the like, but means a machine readable medium that semi-permanently stores the data. Specifically, the non-transitory readable medium may be a CD, a DVD, a hard disc, a Blu-ray disc, a USB, a memory card, a ROM, or the like.

Meanwhile, although it has been described that the exemplary embodiments described above are applied to the transparent display apparatus, the exemplary embodiments are not limited to only the transparent display apparatus, but the color gamut mapping method according to the present disclosure may be applied to various apparatuses for representing colors. Therefore, the present disclosure is not limited to the transparent display apparatus.

Meanwhile, various exemplary embodiments described above may be implemented in a recording medium that is readable by a computer or a device similar to the computer using software, hardware, or a combination thereof. With a hardware implementation, the exemplary embodiments described in the present disclosure may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and electrical units for performing other functions. With a software implementation, exemplary embodiments such as procedures and functions described in the present specification may be implemented by separate software modules. Each of the software modules may perform one or more functions and operations described in the present specification.

According to an embodiment, the methods according to the various embodiments disclosed in the present document may be included and provided in a computer program product. The computer program product may be traded as a product between a seller and a purchaser. The computer program product may be distributed in a form of a storage medium (for example, a compact disc read only memory (CD-ROM)) that may be read by a device or online through an application store (for example, PlayStore™) In the case of the online distribution, at least portions of the computer program product may be at least temporarily stored in a storage medium such as a memory of a server of a manufacturer, a server of an application store, or a relay server or be temporarily generated.

Although the exemplary embodiments of the present disclosure have been illustrated and described hereinabove, the present disclosure is not limited to the above-mentioned specific exemplary embodiments, but may be variously modified by those skilled in the art to which the present disclosure pertains without departing from the scope and spirit of the present disclosure as claimed in the accompanying claims. These modifications should also be understood to fall within the scope of the present disclosure.

What is claimed is:

1. A display method of displaying image data on a transparent display apparatus, the display method comprising:

sensing an illumination in an environment around the transparent display apparatus;

determining a threshold lightness value using the sensed illumination;

correcting the image data by changing, using a first method, a lightness and a chroma of colors having a lightness value brighter than the determined threshold lightness value and changing, using a second method, only the chroma of colors having a lightness value equal to or less than the determined threshold lightness value; and displaying the corrected image data on the transparent display apparatus, wherein, based on a color gamut of the transparent display apparatus being included in a color gamut of the image data, the correcting the image data comprises the changing the lightness and the chroma of the colors having lightness values brighter than the threshold lightness value and the changing only the chroma of the colors having lightness values equal to or less than the threshold lightness value.

2. The display method as claimed in claim 1, wherein, in response to an entirety of a color gamut of the transparent display apparatus not being included in a color gamut of the image data, the correcting the image data further comprises:

changing a lightness value of the image data so that the color gamut of the image data includes the entirety of the color gamut of the transparent display apparatus, changing the lightness and the chroma of colors having lightness values brighter than the threshold lightness value in the image data of which the lightness value is changed, and changing only the chroma of colors having lightness values equal to or less than the threshold lightness value.

3. The display method as claimed in claim 1, wherein the determined threshold lightness value is inversely proportional to an ambient illumination of the transparent display apparatus.

4. The display method as claimed in claim 1, further comprising generating a table mapping colors in a color gamut of the image data to colors in a color gamut of the transparent display apparatus, wherein the correcting the image data further comprises correcting the image data using the generated table.

5. The display method as claimed in claim 4, wherein the table is generated such that, in response to the color gamut of the transparent display apparatus not being entirely included in the color gamut of the image data, the color gamut of the image data is modified so that a lightness of a color having a maximum chroma among the colors in the color gamut of the image data is adjusted to be equal to a lightness of a color having a maximum chroma among the colors in the color gamut of the transparent display apparatus, and such that the table defines a correspondence between the colors in the color gamut of the image data and colors in the modified color gamut of the image data.

6. The display method as claimed in claim 5, wherein the correcting of the image data further comprises first changing the colors of the color gamut of the image data to become the colors in the modified color gamut based on the generated table and changing the colors which are not included in the color gamut of the transparent display apparatus among the first changed colors to become colors in a predetermined region of the color gamut of the transparent display apparatus.

7. The display method as claimed in claim 6, further comprising determining a percentage of the first changed colors which are not included in the color gamut of the transparent display apparatus, wherein a size of the predetermined region is adjusted to be proportional to the determined percentage.

8. The display method as claimed in claim 6, wherein the correcting of the image data further comprises changing a color value of colors which are already included in the color gamut of the transparent display apparatus to a smaller degree than a degree of change applied to the colors which are not included in the color gamut of the transparent display apparatus to change the first changed colors to the colors in the color gamut of the transparent display apparatus.

9. A transparent display apparatus for displaying image data comprising:

a sensor configured to sense an illumination in an environment around the transparent display apparatus;

a processor configured to determine a threshold lightness value using the sensed illumination, and correct the image data by changing, using a first method, a lightness and a chroma of colors having a lightness value brighter than the determined threshold lightness value and changing, using a second method, only the chroma of colors having a lightness value equal to or less than the determined threshold lightness value; and a transparent display configured to display the corrected image data, wherein the processor is configured to correct the image data by changing the lightness and the chroma of the colors having lightness values brighter than the threshold lightness value and changing only the chroma of the colors having lightness values equal to or less than the threshold lightness value based on a color gamut of the transparent display being included in a color gamut of the image data.

10. The transparent display apparatus as claimed in claim 9, wherein in response to an entirety of a color gamut of the transparent display not being included in a color gamut of the image data, the processor is further configured to correct the image data by changing a lightness value of the image data so that the color gamut of the image data includes the entirety of the color gamut of the transparent display, changing the lightness and the chroma of colors having lightness values brighter than the threshold lightness value in the image data of which the lightness value is changed, and changing only the chroma of colors having lightness values equal to or less than the threshold lightness value.

11. The transparent display apparatus as claimed in claim 9, wherein the determined threshold lightness value is inversely proportional to an ambient illumination of the transparent display apparatus.

12. The transparent display apparatus as claimed in claim 9, wherein the processor is further configured to generate a table mapping colors in a color gamut of the image data to colors in a color gamut of the transparent display and correct the image data using the generated table.

13. The transparent display apparatus as claimed in claim 12, wherein in response to the color gamut of the transparent display not being entirely included in the color gamut of the image data, the processor is further configured to modify the color gamut of the image data so that a lightness of a color having a maximum chroma among the colors in the color gamut of the image data is adjusted to be equal to a lightness of a color having a maximum chroma among the colors in the color gamut of the transparent display, wherein the table defines a correspondence between the colors in the color gamut of the image data and colors in the modified color gamut of the image data.

14. The transparent display apparatus as claimed in claim 13, wherein the processor is further configured to correct the image data by first changing the colors of the color gamut of the image data to become the colors in the modified color gamut based on the generated table and changing the colors which are not included in the color gamut of the transparent display among the first changed colors to become colors in a predetermined region of the color gamut of the transparent display.

15. The transparent display apparatus as claimed in claim 14, wherein the processor is further configured to determine a percentage of the first changed colors which are not included in the color gamut of the transparent display, and adjust a size of the predetermined region to be proportional to the determined percentage.

16. The transparent display apparatus as claimed in claim 14, wherein the processor is further configured to correct the image data by changing colors which are already included in the color gamut of the transparent display to a smaller degree than a degree of change applied to the colors which are not included in the color gamut of the transparent display to change the first changed colors to the colors in the color gamut of the transparent display.

17. The transparent display apparatus as claimed in claim 9, wherein the transparent display apparatus is a head mounted display.

18. A non-transitory computer readable recording medium including a program for executing a display method of displaying image data on a transparent display apparatus, wherein the display method includes:

sensing an illumination in an environment around the transparent display apparatus;

determining a threshold lightness value using the sensed illumination;

correcting the image data by changing, using a first method, a lightness and a chroma of colors having a lightness value brighter than the determined threshold lightness value and changing, using a second method, only the chroma of colors having a lightness value equal to or less than the determined threshold lightness value; and displaying the corrected image data on the transparent display apparatus wherein, based on a color gamut of the transparent display apparatus being included in a color gamut of the image data, the correcting the image data comprises the changing the lightness and the chroma of the colors having lightness values brighter than the threshold lightness value and the changing only the chroma of the colors having lightness values equal to or less than the threshold lightness value.

* * * * *